US006231452B1

(12) United States Patent
Novosel, Sr.

(10) Patent No.: US 6,231,452 B1
(45) Date of Patent: May 15, 2001

(54) MAGNETIC PUTTER

(76) Inventor: John Michael Novosel, Sr., 12708 Pembroke La., Leawood, KS (US) 66209

( * ) Notice: Subject to any disclaimer, the term of this patent is extended or adjusted under 35 U.S.C. 154(b) by 0 days.

(21) Appl. No.: 09/480,697

(22) Filed: Jan. 8, 2000

(51) Int. Cl.[7] ..... A63B 69/36; F41B 6/00

(52) U.S. Cl. ..... 473/219; 473/223; 473/235; 473/409; 124/3; 124/44.6

(58) Field of Search ..... 473/131, 199, 473/221, 226, 231, 409, 235, 324, 340, 219; 446/137; 124/3, 5, 44.6; 273/456

(56) References Cited

U.S. PATENT DOCUMENTS 1,914,449 * 6/1933 Murray .
3,466,049 * 9/1969 Fox .
3,554,549 * 1/1971 Grabowski .
3,806,129 * 4/1974 Burrows .
4,085,936 * 4/1978 Patterson .
4,364,371 * 12/1982 Woolard .
4,794,905 * 1/1989 Woolard .
5,114,150 * 5/1992 Matsumura .
5,415,402 * 5/1995 Morrison .
5,417,426 * 5/1995 Bayer .
5,482,282 * 1/1996 Willis .

* cited by examiner

*Primary Examiner*—Sebastiano Passaniti
(74) *Attorney, Agent, or Firm*—Robert M. Hunter

(57) ABSTRACT

A golf club shaft is provided with a pressure actuated switch on the handle and is operatively connected by an electrical circuit to a training head that has electromagnets mounted in both its forward and backward faces. When the golfer presses down on the switch, the energized electrical circuit causes a magnetically influenced ball or balls to attach to either or both of the forward or backward faces of the electromagnets; and when the pressure is let up, the ball instantly detachs from the face and will travel along the line that the device was swung through. Practice with the device provides the user with observable feedback as to the squareness of the face at release and the feel for the proper amount of acceleration needed to propel the ball a specified distance. When a golfer swings the device and releases the switch correctly, the simulated golf ball will have the proper end over end roll and travel straight towards its target at the right speed. The golfer thereby learns at the same time the feel of distance and squareness with a smooth, well timed stroke without having to think about it.

20 Claims, 4 Drawing Sheets

24
26
20
22
30
28

28
22
44
33
40

22
28
38
4.
4.
33
40

32
5.
28
44
42
36
46
32
40
38
5.

28
38
36

MAGNETIC PUTTER

BACKGROUND OF THE INVENTION

1. Field of the Invention

This invention relates to golf instructional or training devices used to improve putting and other strokes around the green.

2. Background Information

Most golfers would agree and statistics show that during a round of golf the majority of strokes are taken around and on the green. Knowing that any improvement in this area would have an enormous effect on a their overall score, golfers have attempted to improve their putting skills by many different methods: namely different styles and components of putters, putting methodology and putting training devices.

Unfortunately the putting devices that have been presented to the public have only focused on individual segments of the putting stroke. Frequently they involved attaching something either to the putter itself, to the golfer, or some restrictive means of connecting both the putter and golfer together. These devices when attached were awkward and cumbersome: and to use these devices the golfer had to adjust to unusual or unnecessary positions; in effect jeopardizing the golfer's sense of touch and feel. For example, U.S. Pat. No. 4085936 to Patterson 1978, had a hook like extension that needed to be pulled to operate the mechanism during the training movement itself; unfortunately this would illustrate what we are talking about as an unnatural, jerky movement that would interfere with the smoothness of the stroke. Any movements required by the inherent design of the training device other that the one being trained should have only the tiniest effect on the smoothness of the total movement.

Since all golfers have different physical characteristics and their approach to putting varies, any training aid that constrains the golfer in order to make them fit a particular method will be ineffective. As we observe the acknowledged great players of all time, we find that they all had different styles of swinging and putting. We see that Bobby Jones, for example, had a very wristy putting stroke. Current instruction would actually teach just the opposite of his stroke, one where the wrists do not vary from their initial configuration during the whole stroke. So we can see there is a need to accommodate all types of putters, no matter what their individual style. For a training device to be helpful it must allow the users to complete their distinctive individual action without restraint. The golfer's usual stance, grip and feel should not be affected by the training device. Also the training device must have feedback on the most important aspects of putting, distance and direction.

The art of putting is composed of two things, direction and distance. Directional control is further broken down into squareness of the clubhead at separation of the ball from the clubhead and direction of the stroke. Most golfers concentrate on one or the other and this causes them to miss putts. A training device that would give golfers a sense of the feel of both acceleration variance, squareness at impact, with the clubhead and shaft moving down the target line at separation, without limiting their personal putting style, and with instant feedback as to the path and distance of the ball would be very helpful.

OBJECTS OF THE INVENTION

This invention relates to an improved method and apparatus for training the movements of the body to properly execute a golfing stroke and, in particular, to a method and apparatus which enables the golfer to simulate a putting stroke that allows the golfer to concentrate on varying the acceleration of the club at impact for distance control while at the same time learning how to square the club up at impact and swing down the target line for accuracy control, without limiting the golfer's personal style.

It is, therefore, the primary object of the present invention to provide a method and apparatus for training a golfer to learn the dual elements of distance and direction at the same time; as a corollary to the foregoing object, it is an important aim of this invention to provide a method and apparatus for training a golfer to properly execute a putting stroke that advantageously promotes the use of the individual player's natural instincts of touch and feel and allows the player to move and putt freely unencumbered by any restraints or having to perform any extraneous motions that substantially detract from the motion being trained.

One of the best ways to learn the feel of distance and direction control is to pitch golf balls underhanded towards a hole on the green from various distances. This gives you a feel of how much force to impart to the golf ball to get it to travel up to the hole, and of course, wherever your hand and ball are aimed and the direction your arm is swinging when you release it, that's where it goes. When you do this, it advantageously allows the use of the player's natural instinct of feel, thing and touch to be heightened; instead of relying on mentally controlling the action. You don't worry about the positions your hands and wrists are in, you don't consciously try to direct the motions of your body; you just sense the speed and direction and time of release that is required to get it to and into the hole. You would never see anyone stab or jab or "yip" such a pitch to a hole, yet when presented with a putter and a ball, these occur frequently to golfers.

As a corollary to the foregoing objects, it is an important aim of this invention to provide an apparatus and method to simulate an underhanded pitching of golf balls to the hole by providing a training club whereby a golfer can instantly attach a ball to the face of the club and then instantly release that ball thru means of a pressure switch controlled magnet. The present invention then, thereby in effect equates the arm and the shaft together, the training head and hand, and the instantaneous releasing action of the hand to the instantaneous releasing action of the magnet and ball.

Another important object of the invention is to provide immediate visual and tactile feedback on where the stroke would have sent a golf ball by observing the amount of force it takes to send the ball a certain distance after it has been released from the training head; this enables the golfer to develop a sense of feel for the variations of speed so critical to applying distance control in putting. The golfer also gets immediate feedback by observing the direction the ball travels after release indicating whether or not the training head was square and the swing was down the target line at release.

Still another important object of the invention is to develop the golfers' natural sense of timing, tempo and rhythm as the player learns how to properly operate the training club. Unless the golfer applies the appropriate timing and touch to the motion of releasing the ball in the correct manner, along the intended target line, the ball will not roll forward towards its intended target in the required manner.

Another important object of the invention is to provide a club provided with a components similar to and weighted similar to a normal golf club, so that when the golfer goes back to his regular equipment, the feel of his training will actually transfer to play on the golf course.

Yet another object of the present invention is to provide a training club that doesn't require any additional extraneous and excess movements associated with its use. With the present invention, you just grab the club, bring the face of the electromagnet in contact with the ball and press the actuating switch, and you're ready to practice. There's no bending over, picking up the ball and having to manually attach it to the training head. There's nothing to distract the user away from a smooth and undisturbed stroke with the training device. For example, the actuating switch that releases the magnetically influenced ball from the training head on our training device only requires the golfer's thumb to release pressure and travel upwards approximately less than one sixty-fourth of an inch; the pressure being exerted by the golfer to actuate the electrical circuit about the same as that required to click a mouse button, such as those attached to a computer. The switch actually aids the golfer in returning to its original unengaged position. Here again similar to the feel of letting up on a mouse button after having clicked on it.

Other and further objects will appear in the course of the following description of the invention.

REFERENCED NUMERALS IN DRAWING

Figure 1:
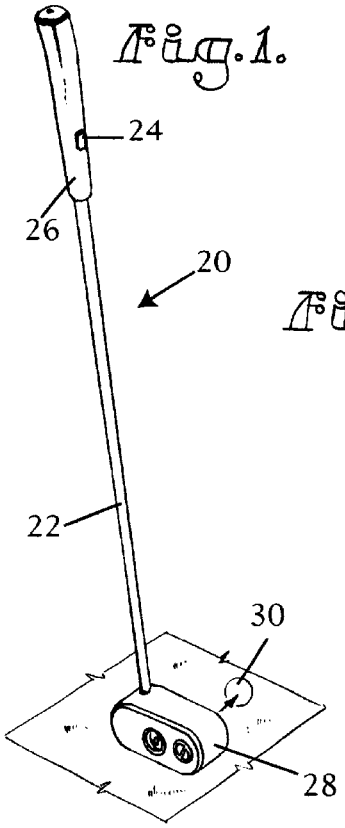
FIG. 1 is a three-quarter perspective view from the front and slightly from above the device itself with a sphere shown on the ground spaced away from the training device itself.
Figure 2:
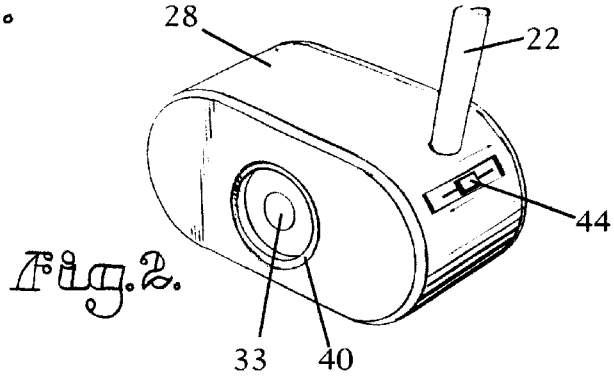
FIG. 2 is a three-quarter perspective view from the other side of the training device showing the single electromagnet and the selective switching means.
Figure 3:
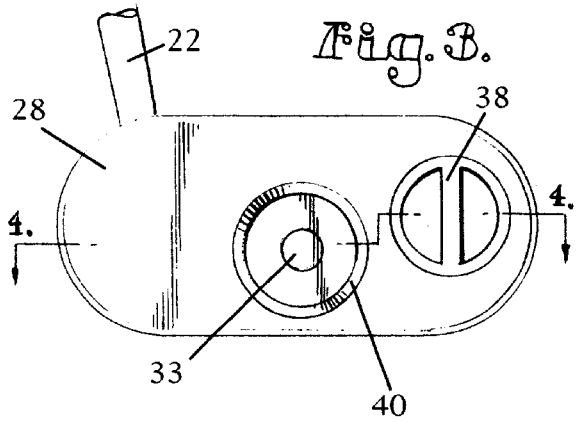
FIG. 3 is an enlarged detail of the side of the putter shown in FIG. 1 with the electromagnet at the left and the receptacle for the battery at the right, the latter sealed off with a battery cap to allow access to the battery when it needs changing.
Figure 4:
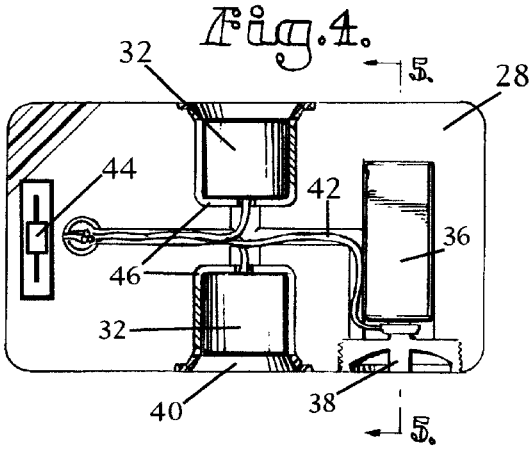
FIG. 4 is a view taken along the line 4—4 in the direction of the arrows showing the opposed electromagnets and the power source with the connections to the power source.
Figure 5:
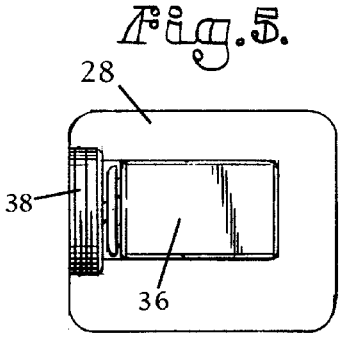
FIG. 5 is a view taken along the lines of 5—5 of FIG. 4 in the direction of the arrows.
Figure 6:
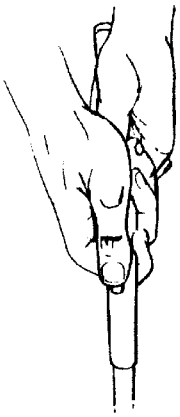
FIG. 6 is a typical putting grasp with the lower hand thumb addressing the pressure activated switch. Under the thumb is seen the pressure activated switch for the power source and the magnets.
Figure 7:
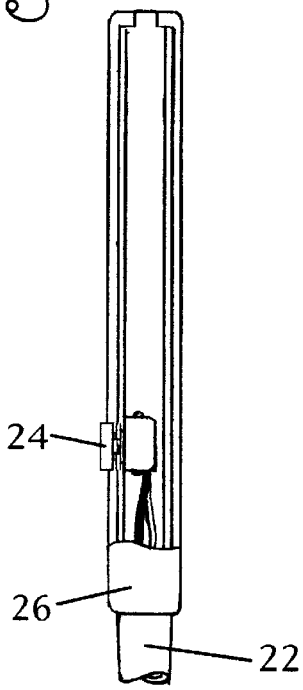
FIG. 7 is a view showing the pressure activated switch that is mounted in the handle.
Figure 8:
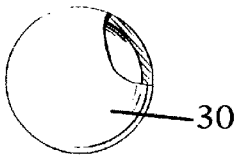
FIG. 8 is a view showing that the "sphere" is a hollow steel or other magnetically influenced sphere approximately but not limited to golf ball size and weight.

20 Training device
22 Elongated shaft
24 Pressure actuated switch
26 Handle
28 Training head
30 Sphere
32 Magnet
33 Face of magnet
36 Battery
38 battery cap
40 Bevel
42 Electrical energizing circuit
44 Selective switch
46 Opening for magnets

SUMMARY

In accordance with the present invention a golf training device comprises an elongate shaft having a pair of opposed ends, one end provided with a handle to be grasped by a user to swing the training device in a golfing stroke. The other end of the device has a training head, similar to a putter head. An electrical wiring circuit connects the handle with the training head. The handle includes a switch that at the volition of the user instantly activates electromagnets that have been installed in the training head at the end of the device. The electromagnets instantly attach and release hollow metal balls similar to golf balls.

DETAILED DESCRIPTION

Referring initially to FIGS. 1–6, 7 and 8 and 12, a training device 20 of the present invention has the usual elongated shaft 22 which, at the upper end thereof, is provided with a handle 26 adapted to be grasped by the player in the normal manner. (seen in FIGS. 6 and 9) This particular handle is equipped with a pressure actuated switch 24 for instantly attaching and releasing a sphere. 30 The lower end of shaft 22 is embedded in provided training head 28 as is clear in FIG. 2. Training head 28 provides opposing magnets for the instant attachment and releasing of a sphere 30. These electromagnets 32 which have been attached and inserted into openings 46 within training head 28 so that when actuated they cause a magnetically influenced sphere 30 to attach immediately to face 33 of magnet 32. Also included in a cavity inside training head 28 is the battery 36 for the electrical energizing circuit 42; a removable battery cap 38 lets the user replace batteries as needed. This electrical energizing circuit 42 is wired from battery 36 to electromagnets 32 to a selective switch 44 to pressure actuated switch 24 so that when pressure actuated switch 24 is pressed down (FIG. 6), the electricity flows thru electrical energizing circuit 42 and causes sphere 30 to attach instantly to face 33 of one or the other, or both electromagnets 32. Electromagnets 32 are recessed into training head 28 and the area surrounding the sides of electromagnets 32 is slightly beveled 40 to help steady sphere 30 in its position.

Figure 12:
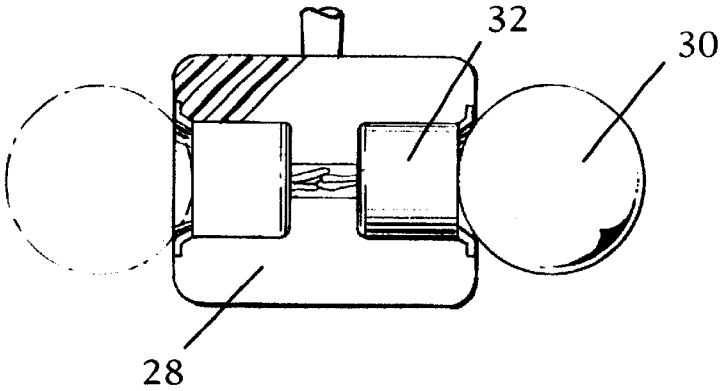
FIG. 12 shows a view taken at right angles to FIG. 4 showing the manner in which the sphere can be attracted by either or both of the opposing electromagnets. This has four uses. That is, the putter is usable by a right or left-handed person, per se, in the action seen in FIGS. 9–11. On the other hand, the sphere can also be used to follow the putter before release, either in the right-handed or left-handed mode.
Figure 13:
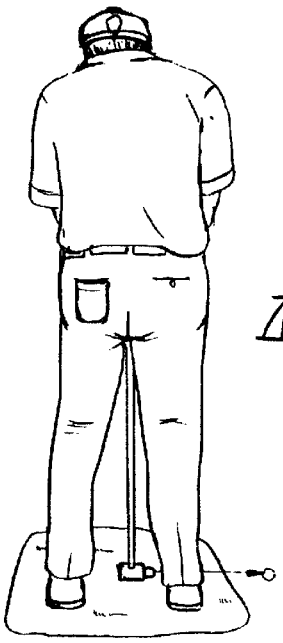
FIG. 13 shows the normal action of a left-handed golfer with the device and is the opposite of FIG. 9 showing the right-handed golfer.
Figure 14:
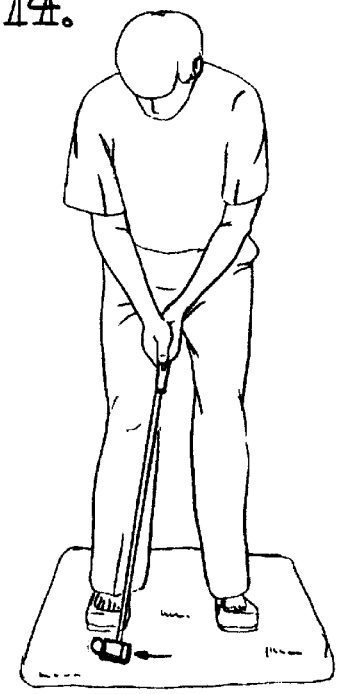
FIG. 14 shows a right-handed golfer as he moves the putter backwardly, analogous to FIGS. 9–11, but with the sphere on the opposite side of the putter.
Figure 15:
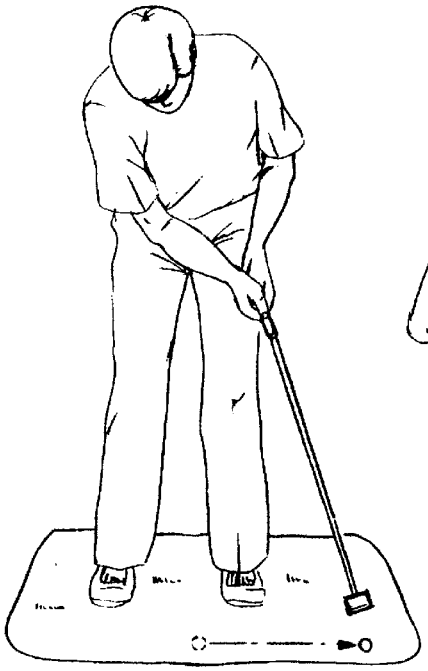
FIG. 15 shows the stroke through with the putter and the sphere released at the point of FIG. 12 but passing under the putter in its action. This figure also illustrates how the device could be used in a chipping action.

For a right-handed golfer, when you move selective switch 44 to the right and press down on pressure actuated switch 24, sphere 30 will attach to electromagnet 32. If selective switch 44 is moved to the left then electromagnet 32 on the left side of training head 28 can attach sphere 30. If selective switch 44 is left in the middle, then both (as seen in FIG. 12) electromagnets 32 could be actuated with spheres 30 on both sides of training head 28.

Figure 9:
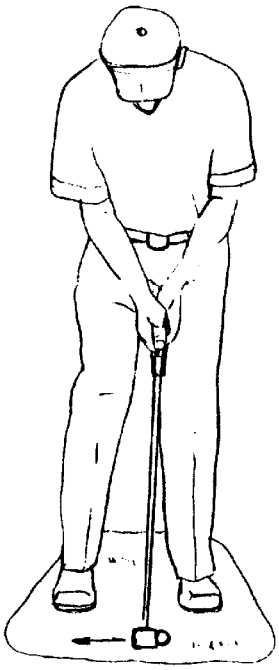
FIG. 9 is a view showing the golfer addressing the sphere just about to pull the training device and attached sphere to the left in the view.
Figure 10:
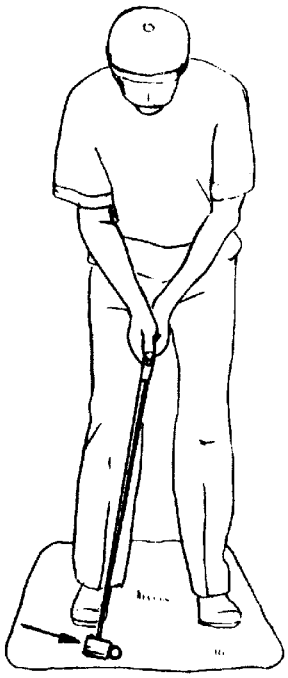
FIG. 10 shows the later stage of FIG. 9 where the sphere, magnetized to the face of the putter starts forward in the swing.
Figure 11:
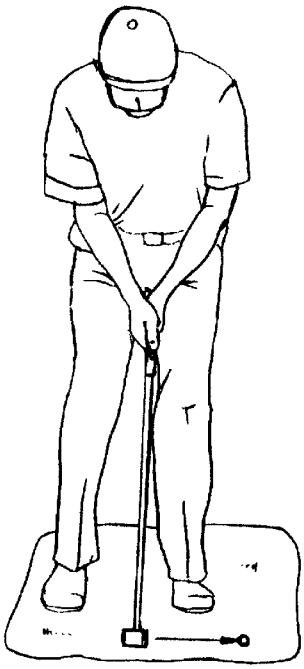
FIG. 11 shows where the golfer has released the magnetic switch and the sphere swings free or moves free of the magnetizer on the putting face.

Practice with training device 20 and sphere 30 of the present invention is illustrated by the sequence of views of FIGS. 6, 9–11 and 13–15. In FIG. 9, the golfer has already attached sphere 30 to the left side of training head 28 by pressing down on pressure activated switch 24 while at the same time allowing face 33 of electromagnet 32 and sphere 30 to come into contact. The player sustains the pressure as he starts at address and just as if putting or chipping takes training device 20 with attached sphere 30 backwards. The golfer then strokes training device 20 forward towards his intended target, all the while sensing the amount of force to apply to lag sphere 30 to its intended target. When the golfer senses training head 28 is aimed towards his target, he then releases the pressure on pressure actuated switch 24 and sphere 30 rolls towards its intended target. (The target could be a hole on the putting green, any one of many commercially available putting mats or just an object to roll the sphere to or into, i.e. a cup on indoor carpet)

Figure 16:
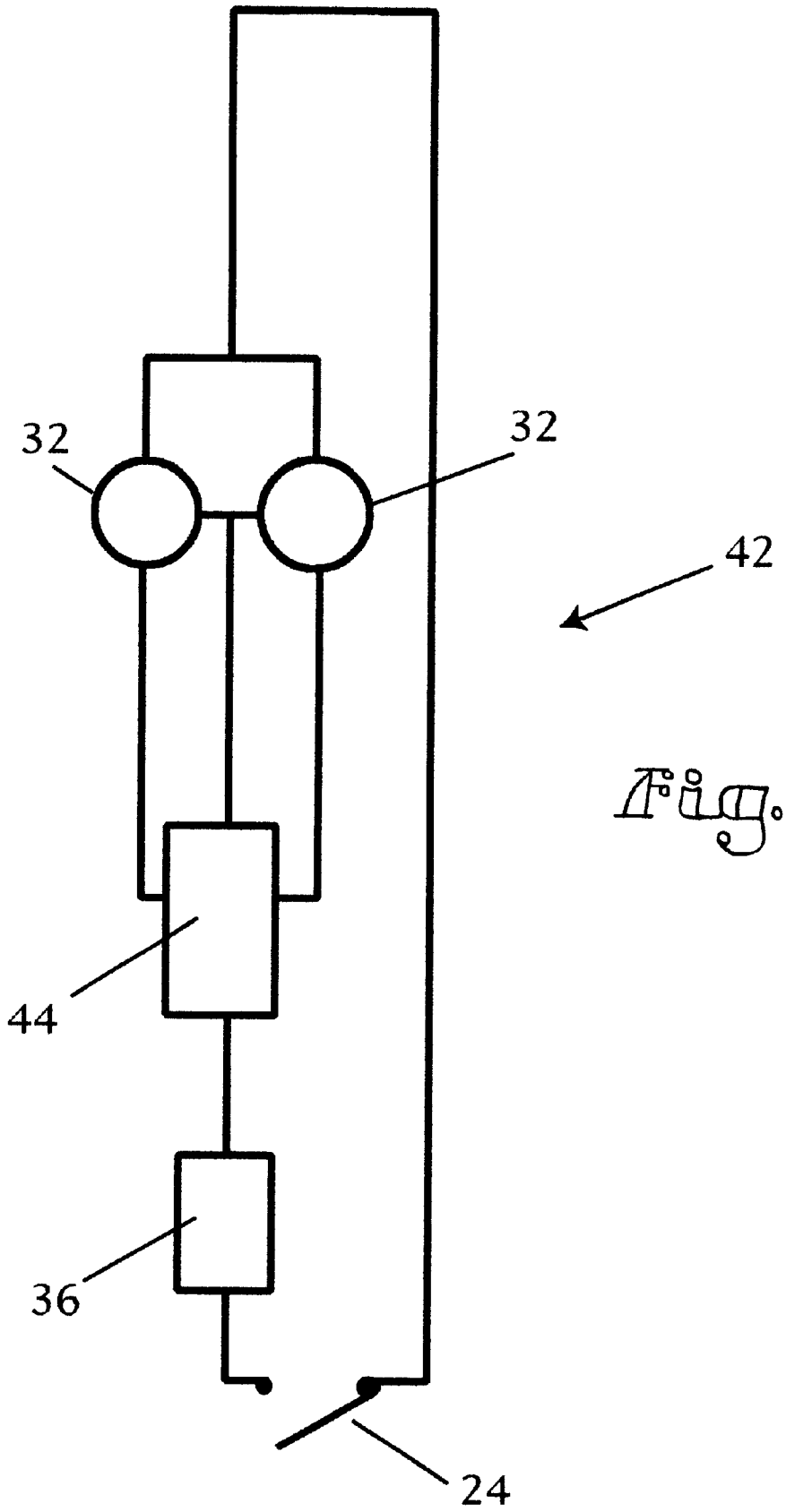
FIG. 16 is a schematic electrical flow diagram of the electric circuit used in the subject device.

FIG. 16 is a schematic that shows how electrical energizing circuit 42 connects pressure actuated switch 24, battery 36, selective switch 44 for electromagnets 32, and electromagnets 32 together with the effect of when pressure actuated switch 24 is activated by pressing down on it, electrical energizing circuit 42 is energized and the sphere 30 attaches to the face 33 of training head 28.

The golfer will learn both distance and direction control by using his natural instincts and will be rewarded with the immediate and observable feedback of where sphere 30 goes. When aimed and released correctly, sphere 30 will travel straight down the intended target line and into the hole or target. Thus with described training device 20 the golfer learns a sense of the feel of both acceleration variance, squareness at impact, with the clubhead and shaft moving down the target line at separation, without limiting their personal putting style, and with instant feedback as to the path and distance of the ball; additionally, training device 20 is shaped similar to and has similar components of a real golf club, so that when golfers go to actual play on the course, the feel they have developed will carry over to their performance on the course.

From the foregoing, it will be seen that this invention is one well adapted to attain all of the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

As many possible embodiments can be made of this invention without departing from the scope thereof, it is to be understood that all matter herein set forth or shown in the accompanying drawings is to be interpreted as illustrative and not in a limiting sense.

Having thus described the invention, what is claimed as new and desired to be secured by letters patent is:

1. A golf training device comprising:

one or more releasable members that are capable of being attracted by a magnet, and an elongate shaft having a pair of opposed ends, one of said ends comprising a grasping end that is configured to be grasped by a user to swing said shaft in a golfing stroke, and the other of said ends comprising means for attaching and releasing said one or more releasable members, wherein said other end is connected to said grasping end by an operative connection, said one or more releasable members is capable of being magnetically attracted to said other end, and said grasping end comprises means for actuating the attachment and release of said one or more releasable members by the conscious volition of the user.

2. The device of claim 1 wherein:

said grasping end is provided with a handle to be grasped by the user to swing said shaft in a golfing stroke, and said means for attaching and releasing one or more releasable members comprises a training head having one or more surfaces to each of which surfaces one of said releasable members is attachable.

3. The device of claim 2 wherein:

said operative connection is between said training head and said handle and said operative connection comprises an electrical energizing circuit, said handle comprises means for instantly actuating said electrical energizing circuit at the volition of the user, said means for attaching and releasing one or more releasable members comprises magnets that can have their magnetic effect instantly actuated on and off when said electrical energizing circuit is actuated on and off at the volition of the user, and each of said one or more releasable members comprises a ball similar in size and shape to a golf ball.

4. The device of claim 3 wherein:

said training head has a forward facing surface and a backward facing surface, said magnets are comprised of two electromagnets that are incorporated into said training head, one is a forward facing electromagnet that is incorporated in the forward facing surface of said training head and the other is a backward facing electromagnet that is incorporated in the backward facing surface of said training head, and said training head comprises switching means that allow the user to selectively activate said forward facing electromagnet, and said backward facing electromagnet or both said forward facing electromagnet and said backward facing electromagnet.

5. The device of claim 1 wherein:

said means for attaching and releasing one or more releasable members is comprised of at least one magnet.

6. The device of claim 5 wherein:

said magnet is an electromagnet.

7. A golf training device comprising:

one or more spheres, an elongate shaft having a pair of opposed ends and an electrical energizing circuit, one of said ends being provided with a handle that may be grasped by a user to swing said shaft in a golfing stroke, said handle having means for instantly actuating said electrical energizing circuit at the volition of the user, a training head on the other of said pair of opposed ends of said elongate shaft, said training head having surfaces and presenting means for selectively and instantly attaching and releasing one of said one or more spheres to one of said surfaces of said training head when said electrical energizing circuit on said handle is actuated, and a source of electrical energy connected to said electrical energizing circuit, wherein each of said spheres is able to respond to a magnetic force.

8. The device of claim 7 wherein:

said means for instantly actuating said electrical energizing circuit is a pressure activated switch, said pressure activated switch being capable of turning said electrical energizing circuit on when depressed and turning said electrical energizing circuit off when released.

9. The device of claim 8 wherein:

said training head has a forward facing surface and a backward facing surface and two electromagnets are incorporated into said training head, one in the forward facing surface of said training head and one in the backward facing surface of said training head, said training head comprises switching means that allow the user to selectively activate the electromagnet in said forward facing surface, the electromagnet in said backward facing surface or both electromagnets in said forward facing surface and said backward facing surface, said electromagnets can have their magnetic effect instantly actuated on and off when said electrical energizing circuit on said handle is actuated on and off at the volition of the user, and each of said electromagnets is capable of attaching and detaching one of said one or more spheres instantly, upon activation of said energizing electrical circuit.

10. The device of claim 9 wherein:

said electrical energizing circuit is comprised of electrical wires connected to said pressure activated switch, said source of electrical energy, said electromagnets, and said switching means of the said training device and is operative to energize said electrical energizing circuit when the user pushes down on said pressure activated switch which causes one of said spheres to attach to one of said surfaces of said training head.

11. The device of claim 7 wherein:

said means for selectively and instantly attaching and releasing is comprised of magnets that can have their magnetic effect instantly actuated on and off when said electrical energizing circuit is actuated on and off at the volition of the user, and each of said magnets is capable of attaching or detaching one of said one or more spheres instantly, upon activation of said energizing electrical circuit.

12. The device of claim 7 wherein:

said means for selectively and instantly attaching and releasing is comprised of electromagnets that can have their magnetic effect instantly actuated on and off when said electrical energizing circuit on said handle is actuated on and off at the volition of the user.

13. The device of claim 7 wherein:

said source of electrical energy is an electrical battery capable of applying enough energy to cause one of said electromagnets to attach one of said spheres to said training head.

14. The device of claim 7 wherein:

said sphere is a ball capable of responding to a magnetic force.

15. The device of claim 7 wherein:

said means for instantly actuating said electrical energizing circuit is a pressure activated switch which is operative to turn said electrical energizing circuit on when depressed and to turn said electrical energizing circuit off when released, said means for selectively and instantly attaching and releasing is comprised of electromagnets that can have their magnetic effect instantly actuated when said electrical energizing circuit on said handle is actuated on and off at the volition of the user, said electromagnets are capable of attaching and detaching one of said one or more spheres instantly, upon activation of said energizing electrical circuit, said training head has a forward facing surface and a backward facing surface and has a shape similar to that of a putter head and two electromagnets are incorporated into said training head, one in the forward facing surface of said training head and one in the backward facing surface of said training head, said training head has switching means that allow the user to have one or more options for activating either said forward facing electromagnet, said backward facing electromagnet or both said forward facing and said backward facing electromagnets, said electromagnets can have their magnetic effect instantly actuated on and off when said electrical energizing circuit on said handle is actuated on and off at the volition of the user, said electromagnets are capable of attaching and detaching a sphere instantly, upon activation of said energizing electrical circuit, said electrical energizing circuit is comprised of electrical wires connected to said pressure activated switch, said source of electrical energy, said electromagnets, and said switching means and is operative to energize said electrical energizing circuit when the user pushes down on said pressure activated switch which causes one of said spheres to attach to one of said surfaces of said training head, said source of electrical energy is an electrical battery capable of applying enough energy to attach one of said spheres to said training head, and each of said spheres is a ball capable of responding to magnetic force.

16. A method of training the movements of a golfer's body so that the golfer uses his inherent instincts of feel and touch to more properly execute a putting or chipping stroke with a golf training device comprising a sphere that is responsive to a magnetic force, a training club providing an elongate shaft having a pair of opposed ends, one of said ends being provided with a handle to be grasped by the golfer to swing said shaft in a golfing stroke, said handle having means for instantly actuating an electrical energizing circuit on and off at the volition of the golfer, training head on the other of said ends of said shaft having a face presenting means for instantly attaching and releasing said sphere when said electrical energizing circuit is actuated on and off at the volition of the golfer, said instantly attaching and releasing means being comprised of magnets that can have their magnetic effect instantly actuated on and off when said electrical energizing circuit on said handle is actuated on and off at the volition of the user, and an electrical energizing circuit including a source of electrical energy, said method comprising the steps of:

pressing on said actuating means thereby attaching the sphere to the face of the training club, taking a regular putting or chipping stance thereby placing the club at an original starting point, drawing the club backward and then bringing the club forward, and when said club is returned approximately to the original starting point, releasing the pressure on said actuating means, thereby releasing said sphere towards its intended target, said releasing of said sphere to target being informative to the golfer as to distance and direction so as to provide usable feedback to the golfer on how to correctly perform the motion for which the golfer is being trained.

17. The method of claim 16 wherein:

said instantly attaching and releasing means is comprised of a forward facing electromagnet and a backward facing electromagnet that can have their magnetic effect instantly turned off when said electrical energizing circuit on said handle is turned off at the volition of the golfer during said releasing step, and said training head comprises switching means that allow the golfer to activate said forward facing electromagnet, said backward facing electromagnet or both said forward facing and said backward facing electromagnets prior to performing said pressing step, and said method further comprises the steps of:

turning off one or both of said electromagnets in said releasing step, and activating one or both of said electromagnets with said switching means prior to performing said pressing step.

18. A golf training device comprising:

a releasable member that is capable of being attracted by a magnet, an elongate shaft having a pair of opposed ends, the first of said ends being configured to be grasped by a user to swing said shaft in a golfing stroke, means for magnetically attaching and releasing said releasable member attached to the second of said ends, and means for actuating said means for magnetically attaching and releasing attached to said first end.

19. The golf training device of claim 18 wherein:

said means for magnetically attaching and releasing comprises an electromagnet.

20. The golf training device of claim 18 wherein:

said means for actuating is a switch.

* * * * *